US008875805B2

(12) United States Patent
Advocaat et al.

(10) Patent No.: US 8,875,805 B2
(45) Date of Patent: Nov. 4, 2014

(54) MOBILE DRILLING SYSTEM AND A METHODOLOGY FOR INSTALLATION OF THE SYSTEM

(75) Inventors: Jan-Diederik Advocaat, Oslo (NO); Jon Hermstad, Oslo (NO); Dag Nikolai Jenssen, Stavanger (NO)

(73) Assignee: KV/Erner Concrete Solutions AS, Lysaker (NO)

( * ) Notice: Subject to any disclaimer, the term of this patent is extended or adjusted under 35 U.S.C. 154(b) by 106 days.

(21) Appl. No.: 13/431,260

(22) Filed: Mar. 27, 2012

(65) Prior Publication Data

US 2012/0247830 A1 Oct. 4, 2012

(30) Foreign Application Priority Data

Mar. 29, 2011 (NO) ..... 20110484

(51) Int. Cl.

| | |
|---|---|
| ***E21B 7/128*** | (2006.01) |
| ***E21B 7/00*** | (2006.01) |
| ***E02B 17/02*** | (2006.01) |
| *E02B 17/00* | (2006.01) |

(52) U.S. Cl.

CPC ..... *E02B 17/0021* (2013.01); *E02B 17/021* (2013.01); *E02B 2017/0069* (2013.01); *E02B 2017/0052* (2013.01); *E02B 2017/0043* (2013.01)

USPC ..... 175/5; 175/7; 166/350; 166/351; 166/353; 405/203; 405/204; 405/205; 405/206; 405/217

(58) Field of Classification Search

CPC ..... E02B 2017/0043

USPC ..... 175/5–7; 166/351–354; 114/264, 125; 405/203, 204, 205, 206, 217

See application file for complete search history.

(56) References Cited

U.S. PATENT DOCUMENTS

| | | | | | |
|---|---|---|---|---|---|
| 1,716,189 | A | * | 6/1929 | Savage | 405/195.1 |
| 3,474,630 | A | * | 10/1969 | Pogonowski | 405/195.1 |
| 3,754,403 | A | * | 8/1973 | Mott et al. | 405/196 |
| 3,938,343 | A | * | 2/1976 | Lamy | 405/226 |
| 3,950,805 | A | * | 4/1976 | Murphy | 441/4 |
| 3,952,527 | A | * | 4/1976 | Vinieratos et al. | 405/217 |
| 4,041,711 | A | | 8/1977 | Lucas | |
| 4,051,686 | A | * | 10/1977 | Lamy | 405/195.1 |
| 4,064,669 | A | * | 12/1977 | Vik | 52/299 |
| 4,102,144 | A | * | 7/1978 | Anders | 405/211 |
| 4,102,288 | A | * | 7/1978 | Berry et al. | 114/41 |
| 4,126,011 | A | | 11/1978 | Lamy et al. | |
| 4,170,187 | A | * | 10/1979 | Schirtzinger | 114/264 |

(Continued)

FOREIGN PATENT DOCUMENTS

| | | | |
|---|---|---|---|
| WO | WO-84/02151 | A1 | 6/1984 |
| WO | WO-02/092425 | A1 | 11/2002 |

(Continued)

*Primary Examiner* — James Sayre
(74) *Attorney, Agent, or Firm* — Winstead PC

(57) ABSTRACT

A mobile drilling system comprising a top member with a drilling rig positioned thereon. The top member is removably engaged with a foundation member. The foundation member comprises a tower. The top member is moveable and adapted to be elevated out of the water for placement on top of the tower. The tower is preferably of concrete and extends out of the water and above any ice. A method is also described by which the top member is elevated out of the water either by jacking down legs or lifting by interaction with the tower.

13 Claims, 7 Drawing Sheets

(56) References Cited

U.S. PATENT DOCUMENTS

| | | | | | |
|---|---|---|---|---|---|
| 4,199,275 | A | * | 4/1980 | Tuson | 405/195.1 |
| 4,239,418 | A | * | 12/1980 | Pearce | 405/211 |
| 4,425,055 | A | * | 1/1984 | Tiedemann | 405/217 |
| 4,451,174 | A | * | 5/1984 | Wetmore | 405/196 |
| 4,486,125 | A | * | 12/1984 | Reusswig | 405/217 |
| 4,511,288 | A | * | 4/1985 | Wetmore | 405/217 |
| 4,512,684 | A | * | 4/1985 | Hale et al. | 405/217 |
| 4,576,518 | A | * | 3/1986 | Cooke et al. | 405/205 |
| 4,627,767 | A | * | 12/1986 | Field et al. | 405/196 |
| 5,593,250 | A | * | 1/1997 | Smith et al. | 405/205 |
| 5,803,668 | A | * | 9/1998 | Seki et al. | 405/204 |
| 6,340,272 | B1 | * | 1/2002 | Runge et al. | 405/203 |
| 6,371,695 | B1 | * | 4/2002 | Davenport et al. | 405/204 |
| 6,374,764 | B1 | * | 4/2002 | Davenport et al. | 114/265 |
| 6,968,797 | B2 | * | 11/2005 | Persson | 114/264 |
| 2012/0201609 | A1 | * | 8/2012 | Foote | 405/208 |

FOREIGN PATENT DOCUMENTS

| | | | |
|---|---|---|---|
| WO | WO-2006/086240 | A1 | 8/2006 |
| WO | WO-2006/133161 | A2 | 12/2006 |
| WO | WO-2007/126477 | B1 | 11/2007 |
| WO | WO-2010/134881 | A1 | 11/2010 |

* cited by examiner

MOBILE DRILLING SYSTEM AND A METHODOLOGY FOR INSTALLATION OF THE SYSTEM

FIELD OF THE INVENTION

The present invention in general relates to an improved mobile drilling system designed for effective functioning for recovery of hydrocarbons in the Arctic environment.

In particular, the present invention relates to undertaking drilling operations in Arctic environment by applying a simple, economic and technically effective technology, which is relocatable and simultaneously withstands the adversities in Arctic environment.

More particularly, the present invention relates to a mobile drilling system according to the preamble of claim 1 and to a methodology, applying the same, according to the preamble of claims 11 and 12.

TECHNICAL BACKGROUND OF THE INVENTION

It is known that in Arctic environments, accumulation of ice is extreme during November to June, resulting in widespread sheet ice. During June to August arctic environment is known to have floe ice. It is now an established fact that the areas at the margin regions of the Arctic Ocean, have substantial reserves of hydrocarbons like oil and natural gas, often below relatively shallow waters.

Oil and natural gas exploration and production drilling in the Arctic waters, has shot up substantial problems in the past, mainly due to the fact that conventional offshore drilling and production platforms/equipments/systems are not adapted to withstand the substantial drift, caused by sheet ice and ice floe. The load acting on such structures, due to ice drift, leave such structures open to the catastrophic possibility of lateral shifting from its position, during drilling. Hence, such structures have been designed to act as very solid and heavy structures such as for example artificial islands, for undertaking drilling and production of hydrocarbons in Arctic environment. However, these structures have to be fixed by heavy anchoring on the sea bed to withstand lateral drifting of ice and can not be moved to other locations. Hence, these structures are then converted to production facility, which involves very expensive modifications in the remote and harsh locations.

The disadvantages as narrated in the preceding paragraph, triggered the need for movable drilling units for undertaking drilling operations in the Arctic environment. Of course, movable drilling vessels known in the art could not be deployed due to their incapability to withstand the heavy lateral drifting of ice. This has marked the popularity of designing movable structures such as gravity based structures for undertaking drilling and production operations in Arctic waters round the year, for recovery of hydrocarbons.

WO84/02151 attempts to disclose one such gravity based structure, as mentioned in the preceding paragraph, specifically designed for the Arctic environment. However, such structure comprising modular ballastic units involves a complex and bulky construction. That apart, it has to be selectively assembled to suite specific conditions and locations.

WO 02/092425 also discloses movable gravity based structure defining mating of a male and female coupling, but in addition to being bulky, such a structure is not suited to withstand the substantial lateral drift caused by ice, in Arctic environment.

WO 2006/086240 discloses a system for stabilizing a gravity based offshore structure which is movable, but this structure has the requirement for having a different substructure anchored to the sea bed for effective functioning of the gravity based structure. That apart, this structure cannot withstand heavy drifting of ice. Moreover, the top side structure cannot be moved without assistance from heavy crane vessels.

WO 2007/126477 discloses a Mobile Year Round Arctic drilling system comprising jack up legs through a hull for its lowering and elevation so that the drilling system can be lowered on the sea bed and also elevated from water on completion of drilling and thereafter moved to a different location. However, it has the disadvantage that the entire drilling system or a substantial portion of it needs to be relocated to a new site, leaving behind at least one foundation unit, for protecting well head. So, relocating such entire structure is cumbersome, time consuming and involves substantial cost. Also, the operation, naturally requiring mandatory penetration of the sea bed by at least one foundation unit is complicated and that apart, the system is heavily dependent on designing of jack up legs for its functioning and involves a complex and expensive design.

U.S. Pat. No. 4,126,011 describes a platform with a floatable top member which is adapted to be attached to a gravity based structure having a tower extension extending above the water surface. The top member has jack-up legs that can be attached to the tower.

A disadvantage of this system is that the jack-up legs are engaged at all times. This means that the legs are subject to ice influence. The jack-up legs will not be able to withstand the substantive forces from the ice and the platform will soon be in jeopardy.

The so-called mobile drilling systems referred to in the preceding paragraphs are hardly moveable and with one, possibly two, exceptions, requires the assistance of heavy crane vessels. They all have one problem or the other in respect of their suitability for application in drilling operations in Arctic waters, for recovery of hydrocarbons.

Accordingly there has been a desire for a mobile drilling system for Arctic environment, which has a simple construction, is economic, is technically effective to withstand heavy lateral ice drift, thereby enabling year round drilling in Arctic waters and has the possibility to be easily shifted from one location to the other without the assistance of other vessels, such as heavy crane vessels. There is also a need to provide protection for the well equipment above the seabed against ice drifts.

The present invention meets above long felt need and other associated needs.

OBJECTS OF THE INVENTION

The primary object of the present invention is to provide a mobile drilling system for Arctic environment which has a simple construction, is economic and technically effective to withstand heavy lateral ice drifting.

It is yet another object of the present invention to provide a mobile drilling system for Arctic environment, which is capable to perform year round drilling operation in Arctic environment.

It is a further object of the present invention to provide a mobile drilling system for Arctic environment which does away with the requirement for removing the entire drilling unit or a substantial portion of it, to a new drilling site once drilling is over.

It is a further object of the present invention to provide a mobile drilling system for Arctic environment which is adapted to relocate the top unit of the system to another drilling site for engagement with another foundation unit for undertaking drilling operations.

It is yet a further object of the invention to provide a mobile drilling system for Arctic environments including a bottom unit that can be reused for a production facility.

It is yet a further object of the present invention to provide a mobile drilling system for Arctic environment which by virtue of its specially configured construction experiences minimum ice load exposure.

It is a further object of the present invention to provide a mobile drilling system for Arctic environment which applies a very simple well head mono tower for production that protects the wells against ice loads.

It is another object of the present invention to provide a method of installation of a mobile drilling system in an Arctic environment which has a simple construction, is economic and technically effective to withstand heavy lateral ice drifting, is capable to perform year round drilling operation in Arctic environment and does away with the requirement for removing the entire drilling unit to a new drilling site once drilling is over.

All through the specification including the claims, the words "top member", "hull", "foundation member", "tower member", "frame", "jack up legs", "ballast tanks", "gravity based structure", "mobile drilling system" are to be interpreted in the broadest sense of the respective terms and includes all similar items in the field known by other terms, as may be clear to persons skilled in the art. Restriction/limitation, if any, referred to in the specification, is solely by way of example and understanding the present invention.

SUMMARY OF THE INVENTION

According to a first aspect of the present invention there is provided a mobile drilling system comprising a top member having a drilling rig positioned thereon, The top member is removably engaged with at least one foundation member. According to the invention the top member is adapted to be removably engaged with a tower member located on a base member of said foundation member. Furthermore, the top member is adapted to be elevated and lowered out of and in to water and is individually transportable to different drilling sites for engagement with another foundation member.

According to a preferred embodiment of the first aspect of the present invention, the base member of the foundation member has a substantial surface area.

Preferably, the foundation member is made of concrete for durability and has a substantial wall thickness to have an adequate wear margin against the ice drift.

More preferably, the foundation member is adapted to be positioned to have a portion of the tower member above ice level and is ballastable and deballastable.

According to another preferred embodiment of the first aspect of the present invention, the top member is locked on top of the tower member.

More preferably, the top member is locked on and rests on a frame positioned between the top member and the tower member.

According to another preferred embodiment of the first aspect of the present invention the top member is designed as a hull unit and the foundation member is designed as a Gravity Based Structure (GBS).

According to a second aspect of the present invention there is provided a method for installation of an arctic drilling system. The invention according to this second aspect comprises floating a foundation member having a base member of substantial surface area and a tower member positioned on said base member, to a drilling site. This is followed by submerging the foundation member to required depth at the drilling site. Thereafter, the method involves, floating a top member or causing it to move by its own propulsion, to the foundation member. Then the steps involve positioning the top member above the tower member and lowering the top member atop the tower member. Finally the top member is locked on the tower member, thereby adding further weight on said foundation member to make it ready for initiation of drilling and for positioning a drilling rig suitably atop the tower member.

According to a preferred embodiment of the second aspect of the present invention, the top member is lowered onto the water after completion of drilling and transported to another drilling site, individually, for engagement with another foundation member.

BRIEF DESCRIPTION OF THE DRAWINGS

Having described the main features of the invention above, a more detailed and non-limiting description of an exemplary embodiment will be given in the following with reference to the drawings, in which.

DETAILED DESCRIPTION OF THE INVENTION

The following describes a preferred embodiment of the invention which is exemplary for the sake of understanding the present invention and non-limiting to the scope of protection.

Figure 1:
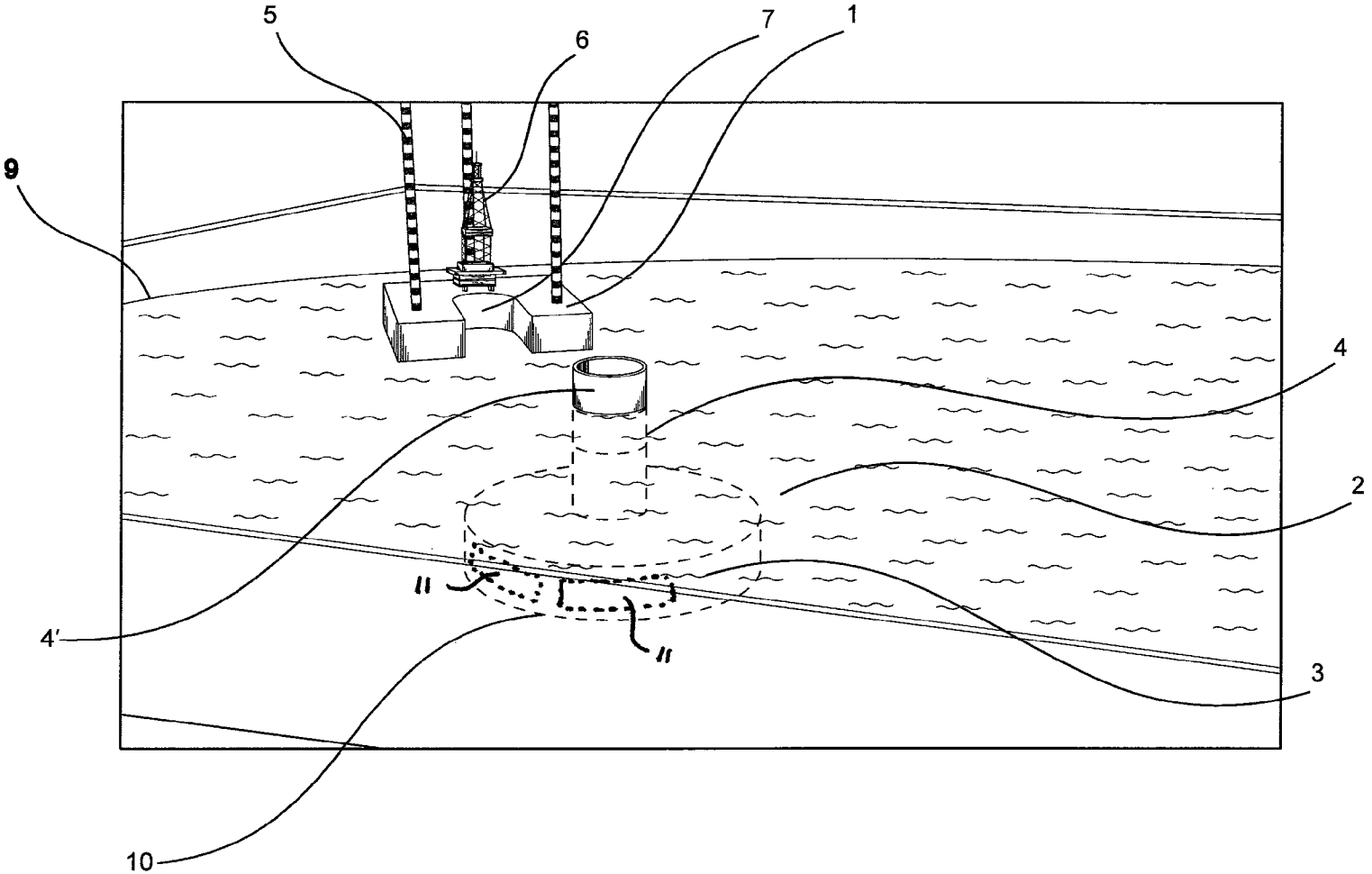
FIG. 1 is a perspective view of a preferred embodiment of the mobile drilling system according to the present invention.

The accompanying FIG. 1 illustrates a perspective view of a preferred embodiment of the mobile drilling system according to the present invention. It comprises the top member 1, which may be designed as a hull unit with self propulsion or be adapted for towing by one or more assist vessels. It consists of three or more jack up legs 5 and a recess 7 in the hull. The drilling rig is preferably suitably located on the top member 1 while it is being installed.

The accompanying FIG. 1 also illustrates the foundation member 2, designed in the form of a gravity based structure. It has a base member 3 having a substantial surface area or in other words it has a substantial diameter to have good contact with the seabed and thereby resist transferring loads from ice, waves or other forces to the seabed.

The gravity based structure (hereinafter referred to as GBS at places, for the sake of brevity) also comprises a mono tower 4 on the base member 3, at an angle substantially perpendicular to the base member 3. The mono tower is designed as shaft like structure (sometimes referred to as shaft hereinafter). Instead of a mono tower a plurality of towers may be used. Inside each tower there may be drilled one or more wells.

The GBS is preferably made of concrete, which is a relatively cheap material suitable for making large and heavy structures. The tower portion 4 of the GBS is made with a thick enough wall thickness to have a sufficient wear margin at the elevations exposed to the ice drift. It also comprises ballast tanks (represented as item 11) at its base 3 and therefore, is adapted to be ballasted and de-ballasted as explained hereinafter.

From the structure of the GBS 2 as illustrated in the accompanying FIG. 1, it should be clear that it is also designed to have a substantially high moment of inertia to exhibit resistance to ice loading on location. Moreover, the substantial diameter increases the bending load resistance to resist ice force. The thick wear margin through the ice belt also contributes to its suitability for application in an Arctic environment.

The FIG. 1, also illustrates the water level 9 and the sea bed 10 at the drilling site.

Now, how the drilling system according to the present invention functions is explained elaborately, with reference to the FIGS. 1 to 7 where the same reference numeral indicates the same features as in FIG. 1.

At least one GBS 2 is transported to a drilling site, preferably by filling the ballast tanks 11 in its base member 3 with air. Then the ballast tanks 11 are filled with water to cause it to sink below the water level 9 to the required depth on the sea bed 10, so that a portion 4' of the tower member 4 remains above the expected ice-level. This process may be also enhanced/caused by applying suction underneath the GBS and/or by any other process for adding weight from top of the GBS, as will be understood by persons skilled in the art.

Figure 2:
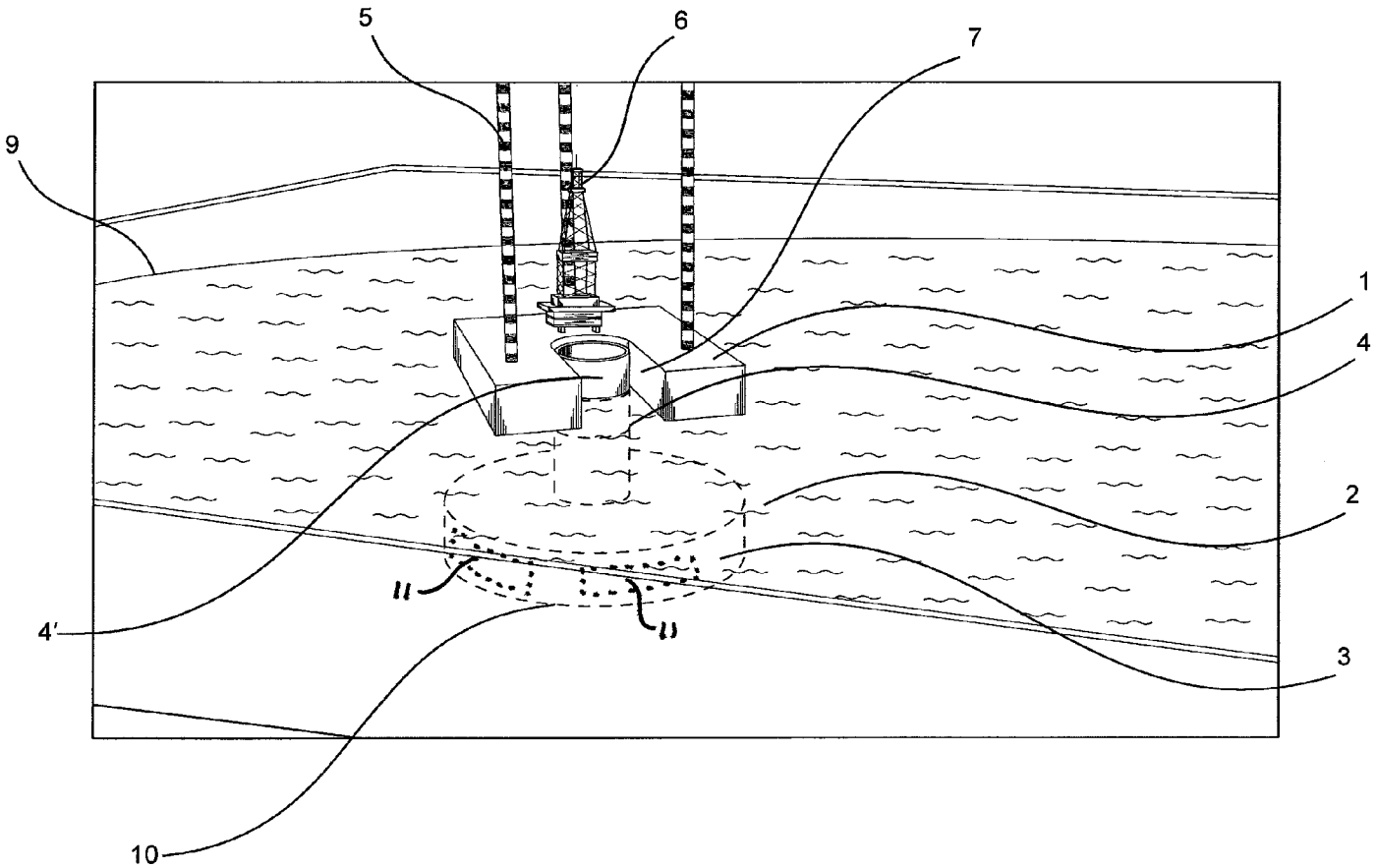
FIGS. 2 to 7 illustrate different stages involved in undertaking installation and drilling operations of the preferred embodiment of the mobile drilling operation according to the present invention, illustrated in FIG. 1.

Then the top member 1 is brought along the side of the GBS 2 at the drilling site by floating or by its own propulsion. This may alternatively be done by barging, following conventional techniques. The drilling rig 6 is preferably already installed on the top member 1. The top member 1 is then positioned such that it partially surrounds tower member 4 within the recess 7. This is illustrated in FIG. 2.

Figure 3:
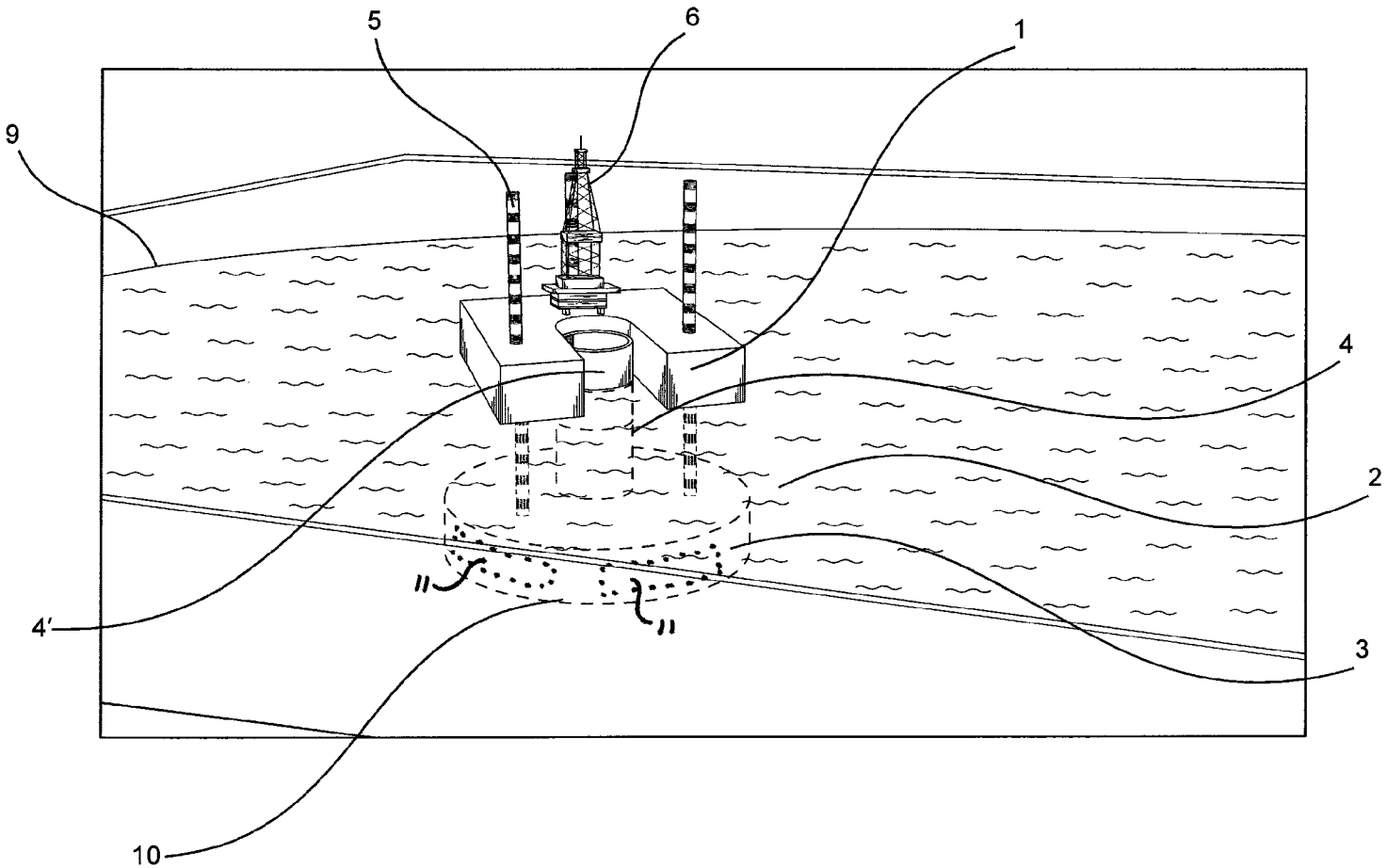

The top member 1 is then lifted atop the tower member 4 by lowering the jack-up legs 5 onto the top surface of the base member 3 or alternatively the sea bed 10, as shown in FIG. 3. It should be understood to persons skilled in the art that the top member 1 can be lifted by other means also, such as by winches and wires (not shown) attached to the top of the shaft 4 or by a rack and pinion arrangement (not shown). The adaptability of the top member 1 to be lifted above water 9 is consequential to the present invention, but how it is lifted is not consequential to the present invention. The present invention embraces all such lifting techniques.

Figure 4:
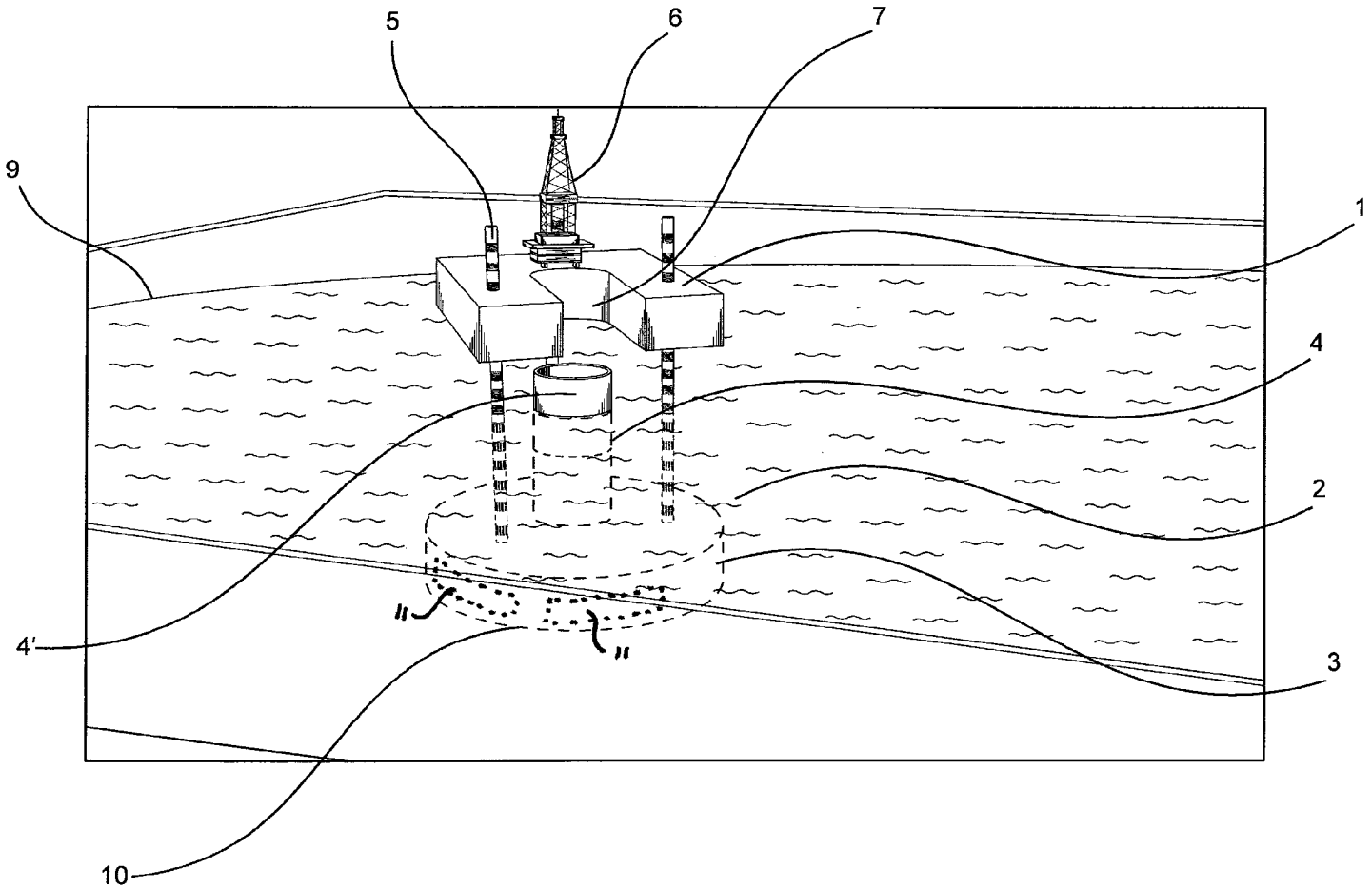
Figure 5:
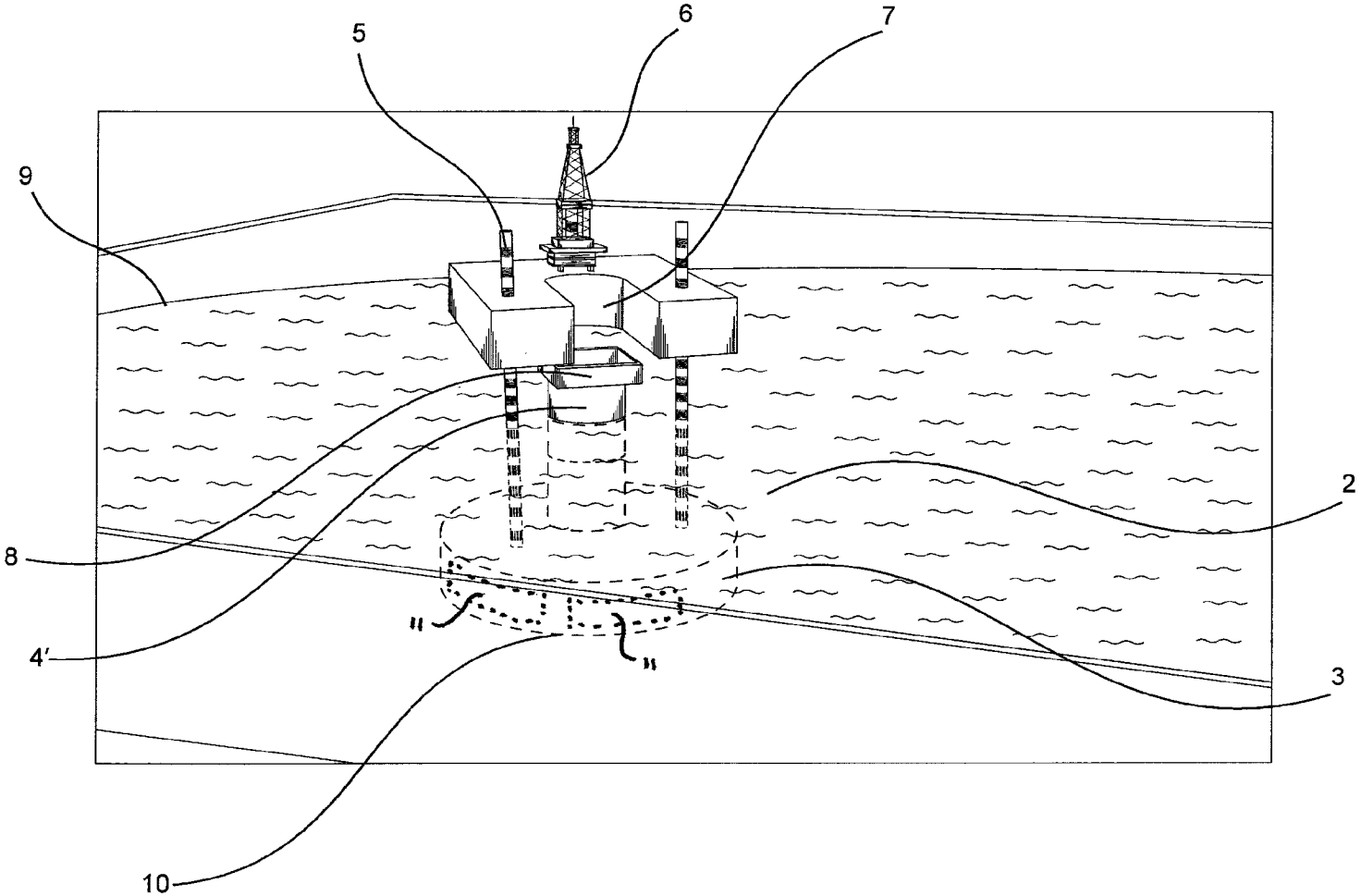
Figure 6:
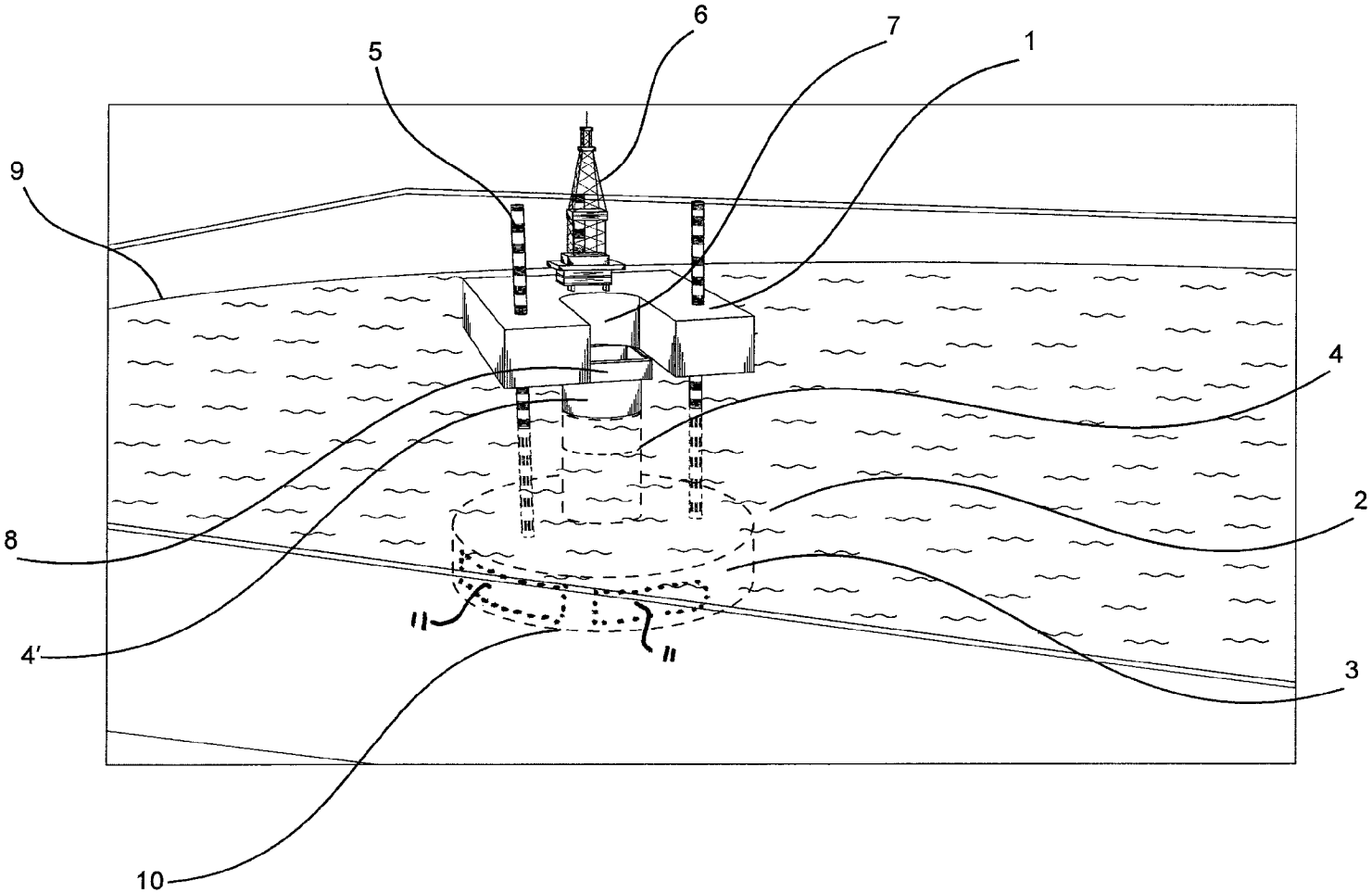

FIG. 4 illustrates a position where the top member 1 has been raised to an adequate height above the water level 9 and above the top of the tower 4. At this stage, a frame member 8 is preferably barged to the drilling site and inserted on top of the tower member 4' between the top unit 1 and the tower member 4' as shown in FIG. 5. This is done following conventional techniques, such as explained in principle in WO 2010/134881. When the frame 8 has been installed and secured to the tower 4, the top member 1 is lowered by upward movement of the legs 5 or otherwise as explained in the preceding paragraph, such that it comes to rest atop the frame member 8. The beginning of this process is shown in FIG. 6.

Figure 7:
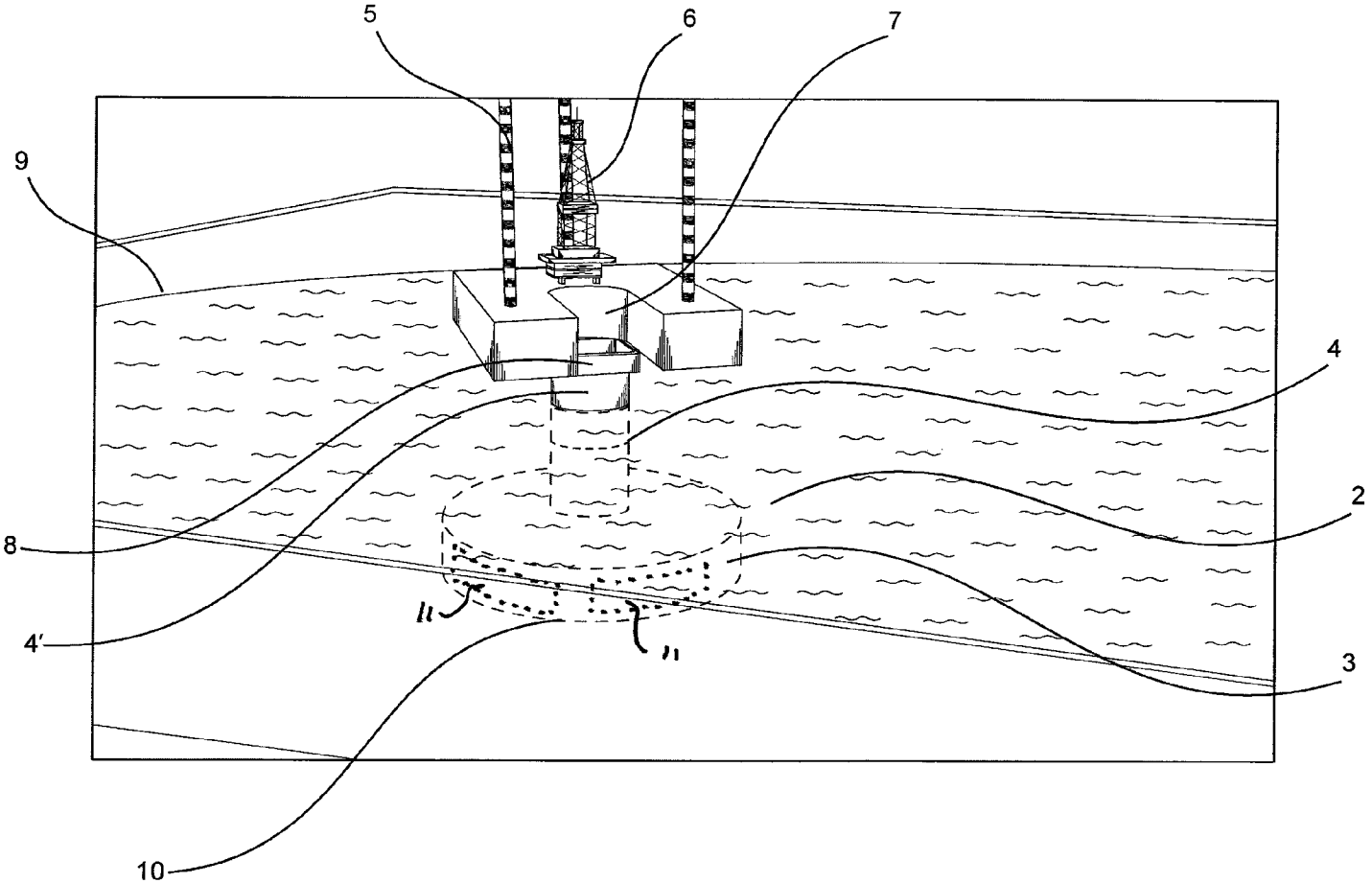

The FIG. 7 shows the top member 1 locked and secured (by means not shown) onto the frame member 8, thereby adding further weight on the GBS 2 to make it ready for initiation of drilling operation. The legs 5 are now completely out of the water 9.

To position the top member 1 correctly on the frame 8, there may be skidding means (not shown) between the frame and the top member. Now the drilling rig 6 is suitably positioned and drilling is initiated through the interior of the tower member 4. To this end the tower 4 and the base structure 3 has a large internal bore that extends all the way from the top of the tower 4 to the seabed 10.

The coupling of the top member to the tower may be done by other means than the frame 8. For example, there may be locking means (not shown) that can be folded outward for directly locking the top member 1 on to the tower 2.

It is also possible to have means, such as racks on the tower that interacts with pinions on the top member, for hoisting the top member up along the tower. Thereby the legs may be dispensed with.

Once the drilling at a particular site is completed, the top member 1 is lowered in water 9 by application of legs 5 in the reverse order as explained above, or by the other means as explained above, and moved to another drilling site, for engagement with another GBS that has already been installed at the next drilling site.

It should be understood, that according to the present invention, a plurality of GBS may be deployed at a plurality of drilling sites for engagement with top members 1 one after another to function in the manner as explained hereinbefore.

After completion of each phase of drilling, the GBS may serve as a wellhead platform to protect a well head. A production facility may then be installed on top of the tower 4. The production facility will be used for a substantially longer time than the drilling facility and may therefore be permanently attached to the tower.

Alternatively, if so desired depending upon requirement, the ballast tanks 11 in the GBS may be emptied to make the GBS afloat. It may then be floated to a new drilling site for deployment. This may be done, for example, if the reserve of hydrocarbons at a particular site is found to be inadequate or if the reservoir is depleted. However, this is not mandatory according to the present invention, as will be understood by persons skilled in the art. What the present invention in particular facilitates is removal of the top member for engagement with another GBS, at another drilling site. The invention also provides the possibility for a GBS designed to be removable and reusable.

The present invention also embraces a method of producing hydrocarbons by drilling a well, applying the drilling system of the present invention.

It will be understood from the exhaustive disclosure above and also from the appended claims, that the mobile drilling system according to the present invention has a simple construction, is economic and technically effective to withstand heavy lateral ice drifting in Arctic environment. This is also due to the fact that all vulnerable parts are situated well above the sea surface and also above the expected ice level. This also means that it is capable of performing year round drilling operation in Arctic environment. The wells are protected against ice and wave loads inside the GBS.

The top member is preferably installed or relocated during the Summer and Autumn months, when the risk of ice is minimal. Drilling can then be performed during the Winter and Spring months, when ice prevents the top member from being floated.

Furthermore, it does away with the requirement for removing the entire drilling unit to a new drilling site once drilling is over. Precisely, the need for GBS relocation, being a mandatory requirement, in prior art drilling techniques in Arctic environment is done away with. This is achieved by the top unit which can be relocated to another drilling site for engagement with another GBS for undertaking drilling operations.

The mobile drilling system for Arctic environment, according to the present invention, by virtue of its specially configured construction experiences minimum ice load exposure. It also applies a very simple well head mono tower. This system can be effectively applied in Non-Arctic drilling operations as well.

The present invention has been described with reference to a preferred embodiment and some drawings for the sake of understanding only and it should be clear to persons skilled in the art that the present invention includes all legitimate modifications within the ambit of what has been described hereinbefore and claimed in the appended claims.

The invention claimed is:

1. A mobile drilling system comprising:

a top member having a drilling rig positioned thereon;

wherein said top member is floatable in order to be transported to different drilling sites and is removably engageable with a tower member located on a base member of a foundation member;

wherein said tower member has a portion extending above an expected ice level;

wherein the foundation member is ballastable and deballastable, so that it can be floated to an installation site, said top member having jack up legs for elevating and lowering the top member out of and in to water;

wherein the top member comprises a recess formed in a side of the top member, the recess receives and partially surrounds a circumference of the tower member; and wherein said top member is adapted to be locked on top of said tower member so that the jack up legs can be lifted out of the water after the top member has been engaged with the tower member.

2. The mobile drilling system according to claim 1, wherein said base member of said foundation member has a surface area against a seabed which is substantially larger than a cross section of the tower member.

3. The mobile drilling system according to claim 1, wherein said foundation member is made of concrete and that the tower member has a substantial wall thickness to have an adequate wear margin at the ice influenced elevation.

4. The mobile drilling system according to claim 1, wherein said top member is locked on and rests on a frame positioned between said top member and said tower member.

5. The mobile drilling system according to claim 1, wherein said top member is a self floating hull unit and said foundation member is a Gravity Based Structure (GBS).

6. The mobile drilling system according to claim 1, wherein the jack up legs are disposed against at least one of a seabed and the foundation member during elevating and lowering of the top member.

7. A method for installation of an arctic drilling system, the method comprising the steps of:

a) floating a foundation member comprising a base member of substantial surface area and a tower member to a drilling site;

b) submerging said foundation member to rest on a seabed at the drilling site such that a portion of said tower member remains above an expected ice level;

c) floating a top member or causing it to move by its own propulsion to a close proximity of said foundation member;

d) positioning the top member such that a recess formed in a side of the top member at least partially surrounds a circumference of the tower member;

e) positioning said top member above said tower member by lifting said top member by lifting means acting between the top member and the seabed or between the top member and the foundation, lowering said top member on top of said tower member by application of the lifting means, locking the top member to the foundation; and f) lifting the lifting means out of the water.

8. The method according to claim 7, comprising lowering said top member onto a water surface after completion of drilling and repeating steps c) and onwards for installation of said top member at a second drilling site for mutual engagement with a second foundation member, suitably positioned at said second drilling site.

9. The method according to claim 7, comprising emptying ballast tanks in said foundation member after completion of drilling and moving it to rest on a second drilling site by applying steps (a) and (b).

10. The method according to claim 7, comprising using said foundation member after completion of drilling to support a production facility.

11. The method of claim 7, wherein the positioning the top member above the tower member comprises disposing the lifting means against at least one of a seabed and the foundation member during elevating and lowering of the top member.

12. A method for installation of an arctic drilling system, the method comprising the steps of:

a) floating a foundation member comprising a base member of substantial surface area and a tower member positioned on said base member, to a drilling site by filling up ballast tanks with air, said ballast tanks being located in said base member;

b) submerging said foundation member to a required depth at the drilling site by filling said ballast tanks with water and/or by applying suction force beneath said foundation member while maintaining a portion of said tower member above an expected ice level;

c) floating a top member or causing it to move by its own propulsion to a close proximity of said foundation member;

d) positioning the top member such that a recess formed in a side of the top member at least partially surrounds a circumference of the tower member;

e) lifting said top member above said tower member by virtue of jack up legs operatively connected to said top member, said jack-up legs acting against a seabed or said foundation member;

f) transporting a frame member to said drilling site and inserting the same on top of said tower member between said top member and said tower member;

g) lowering said top member by upward movement of said legs such that it comes to rests atop said frame member and locking said top member on said frame member; and h) lifting the jack up legs out of the water.

13. The method of claim 12, wherein the lifting the top member above the tower member comprises disposing the jack up legs against at least one of a seabed and the foundation member during elevating and lowering of the top member.

* * * * *

UNITED STATES PATENT AND TRADEMARK OFFICE

CERTIFICATE OF CORRECTION

PATENT NO. : 8,875,805 B2
APPLICATION NO. : 13/431260
DATED : November 4, 2014
INVENTOR(S) : Jan-Diederik Advocaat et al.

It is certified that error appears in the above-identified patent and that said Letters Patent is hereby corrected as shown below:

TITLE PAGE: ITEM 73: Replace "KV/Erner Concrete Solutions AS" with
-- Kvaerner Concrete Solutions AS --

Signed and Sealed this
Seventeenth Day of February, 2015

Michelle K. Lee

Michelle K. Lee
*Deputy Director of the United States Patent and Trademark Office*